United States Patent [19]

Singleton

[11] Patent Number: 4,680,994

[45] Date of Patent: Jul. 21, 1987

[54] SOCKET WRENCH WITH REVERSING RATCHET

[75] Inventor: Robert P. Singleton, Birmingham, Ala.

[73] Assignee: Sidewinder Products Corporation, Birmingham, Ala.

[21] Appl. No.: 771,625

[22] Filed: Sep. 3, 1985

Related U.S. Application Data

[63] Continuation-in-part of Ser. No. 746,673, Jun. 20, 1985, Pat. No. 4,620,459.

[51] Int. Cl.[4] ..... B25B 13/46; B25B 17/00

[52] U.S. Cl. ..... 81/57.29; 81/57.39

[58] Field of Search ..... 81/57.28–57.31, 81/57.39, 57.45, 57.42, 57.12–57.14, 57, 58.1, 63.1–63.2, 180.1

[56] References Cited

U.S. PATENT DOCUMENTS

| | | | |
|---|---|---|---|
| 3,099,177 | 7/1963 | Kostka | 81/63.2 |
| 3,972,252 | 8/1976 | Hunter | 81/57.29 |
| 4,262,561 | 4/1981 | Mize | 81/57.29 |
| 4,311,072 | 1/1982 | Hudgins | 81/57.29 X |

FOREIGN PATENT DOCUMENTS

| | | | |
|---|---|---|---|
| 17354 | 6/1913 | France | 81/63.2 |
| 978620 | 4/1951 | France | 81/57.29 |

*Primary Examiner*—Frederick R. Schmidt
*Assistant Examiner*—Debra S. Meislin
*Attorney, Agent, or Firm*—Nies, Webner, Kurz & Bergert

[57] ABSTRACT

A speed socket wrench which substantially reduces the work required to remove nuts or bolts is disclosed. The wrench includes a bevel gear and mating bevel pinion mounted respectively on a gear shaft and pinion shaft. A drive shaft is provided on the outer end of the pinion shaft. Interlocking cap elements are provided on the outer end of the drive shaft for releasably locking the drive shaft to prevent rotation thereof. In one embodiment, the cap elements include inner and outer caps which cooperate to provide a locking mechanism. In the locked position of the caps, the wrench can be employed as would any conventional wrench. In the unlocked position, a handle on the outer end of the gear shaft is rotatable by hand, resulting in revolving of the drive shaft. The gears of the present wrench turn freely in either direction and gear ratios and sizes can be varied with wrench size. In a further embodiment, a reversing ratchet mechanism is employed to lock the drive shaft.

4 Claims, 8 Drawing Figures

FIG. 4
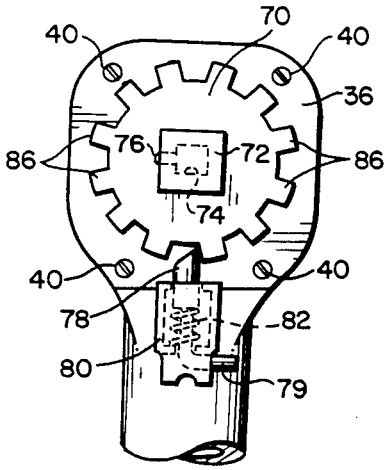
FIG. 5
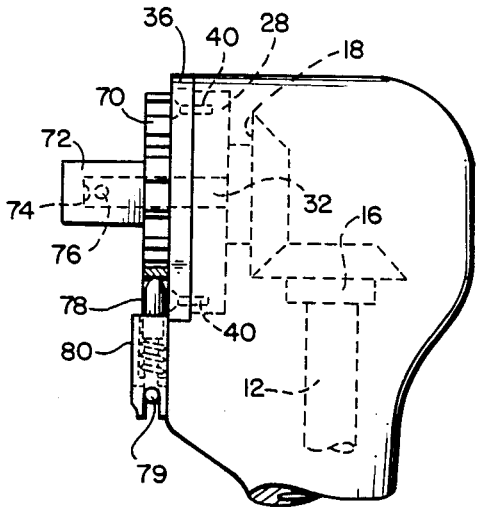
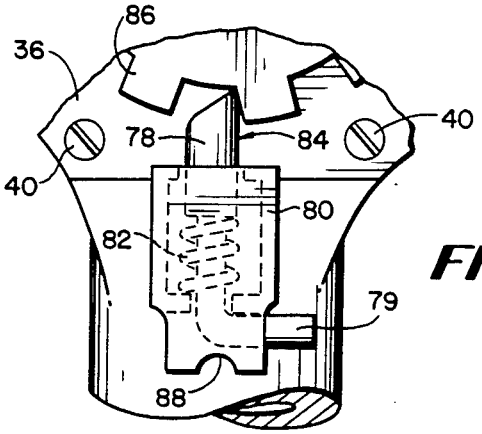
FIG. 6
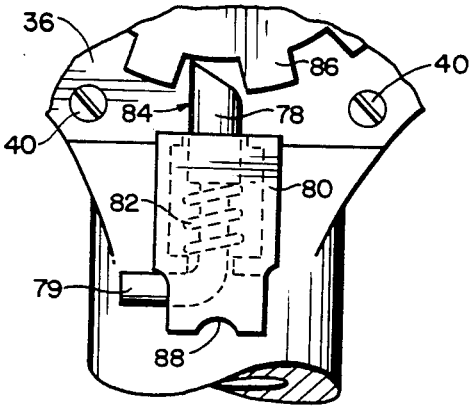
FIG. 7
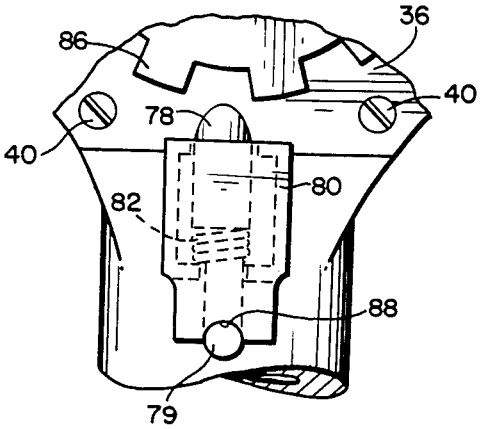
FIG. 8

SOCKET WRENCH WITH REVERSING RATCHET

BACKGROUND AND SUMMARY OF THE INVENTION

This is a continuation-in-part of application Ser. No. 746,673 filed June 20, 1985, now U.S. Pat. No. 4,620,459.

The present invention relates to a wrench and more particularly to a speed socket wrench which provides a compact and reliable construction which is best suited for use in places which are ordinarily inaccessible and where space is limited.

The present invention provides a wrench which will enable inaccessible nuts to be manipulated without difficulty, which can be easily and quickly adjusted and which is not subject to breakage or loss of working ability. By the present invention there is provided a wrench that is strong, durable, simple and inexpensive in construction and well adapted to the use for which it is intended.

The sidewinder wrench of the present invention is a speed socket wrench which employs a bevel gear and pinion set, each of which is attached to a shaft. The bevel gear is attached through its shaft to a T-handle and the pinion set is attached to the drive mechanism.

A pair of bushings are employed on each shaft. The gear shaft, and thus the pinion shaft and drive, can be revolved by turning the T-handle while holding the wrench casing. In one embodiment, an inner and outer cap are located on the exterior of the casing adjacent the point at which the drive shaft exits the casing. These caps cooperate to provide a locking mechanism. In the locked position of the caps, the wrench can be employed as would any conventional wrench. In the unlocked position, the T-handle is rotated by hand, resulting in revolution of the drive shaft. The gears of the present wrench turn freely in either direction and gear ratios and sizes can be varied with wrench size.

In another embodiment, a reversing ratchet is employed, including a ratchet wheel which engages the drive shaft and also including means for locking the ratchet wheel so as to prevent rotation of the drive shaft.

The sidewinder wrench of the present invention has been found to substantially reduce the work required to remove nuts or bolts, as compared with conventional wrenches. The present wrench uses mechanical advantage in two ways rather than one way as in the case of previous wrenches: (1) to provide torque to break or tighten the nut or bolt; and (2) to provide speed, in that with the sidewinder wrench, one turn of the handle results in two turns of the nut or bolt, whereas with existing wrenches, one turn provides ¼ or less turn of the nut or bolt.

Additional features of the wrench of the present invention include the following: (1) requires less room to operate than conventional wrenches; (2) especially effective on long bolts because of the large number of repetitions or on bolts where there is minimal resistance because other wrenches require resistance; and (3) since the handle does not move, the wrench does not tend to slip off the nut or bolt.

BRIEF DESCRIPTION OF THE DRAWINGS

FIG. 4 is an end view of a second embodiment of the invention with reversing ratchet.

FIG. 5 is a side elevation of the embodiment of FIG. 4.

FIGS. 6 through 8 are enlarged views showing a portion of FIG. 4 relating to three positions of the ratchet pawl.

DESCRIPTION OF THE PREFERRED EMBODIMENTS

Figure 1:
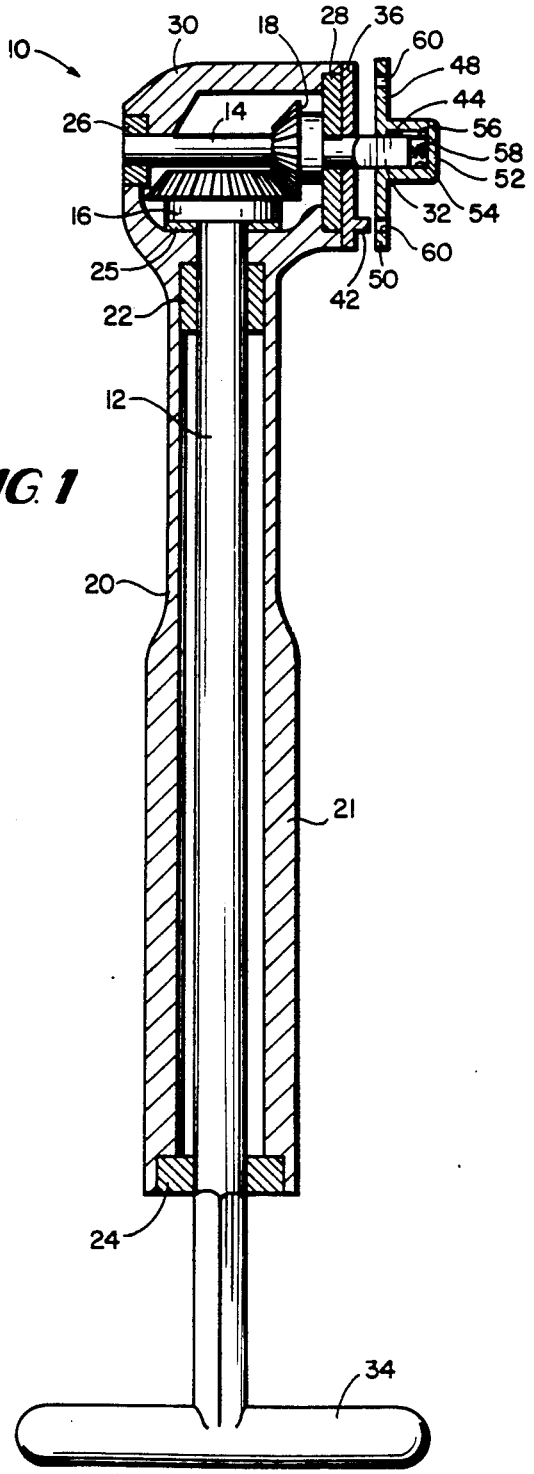
FIG. 1 is a side elevation in cross section of the sidewinder wrench of the present invention.
Figure 2:
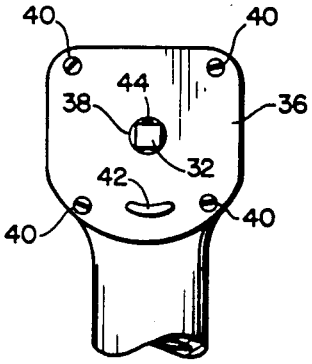
FIG. 2 is an end view of the wrench of FIG. 1, taken from the right side of FIG. 1, with the outer cap removed.
Figure 3:
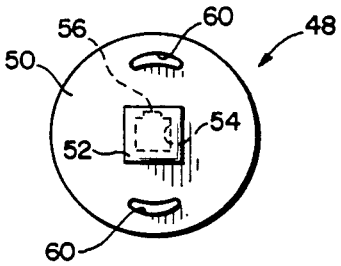
FIG. 3 is a side elevation of the outer end cap employed with the wrench of FIG. 1.

In the embodiment of the invention as shown in FIGS. 1–3, there is provided a speed socket wrench 10 which includes a gear shaft 12 and pinion shaft 14. A bevel gear 16 mates with a bevel pinion 18 mounted respectively on the gear shaft 12 and pinion shaft 14.

The gear shaft 12 is mounted in a casing 20 so as to be rotatable within a bushing 22, 24 mounted at each end of the casing. In a similar manner, the pinion shaft 14 is mounted within a pair of bushings 26, 28 mounted in gear housing 30 formed in the upper end of the casing 20. A drive shaft 32 is provided on the outer end of the pinion shaft 14. The bushings provide support to the respective shafts and also assist in maintaining the gears in proper mesh. The casing 20 and housing 30 provide additional support to the respective shafts to resist bending.

The gear shaft 12 is mounted at 90 degrees relative to the pinion shaft 14. Thus the gear shaft 12 and therefore the pinion shaft 14 and drive 32 can be revolved by turning a T-handle 34 mounted at the lower end of the gear shaft 12. A bushing 25 is mounted at the upper end of the shaft 12 within the housing 30 to provide a smooth surface for the bevel gear 16.

The T-handle 34 provides a mechanical advantage in torque on the shaft 12. An L-shaped handle could be employed if desired. The handle could also be constructed of two pieces which slide back and forth to form a T or L-shape as desired, or as a two piece swivel construction. The casing 20 is sized to fit the hand on the lower end 21 where it will be held. A first or inner cap 36 in the form of a planar member having a circular central opening 38 is positioned adjacent the bushing 28 outwardly thereof and secured to the face of the housing 30 by means such as set screws 40. Where the pinion shaft 14 exits the first cap 36, the shaft 14 changes from circular cross section to square cross section. The cap 36 assures an accurate gear mesh by securing the bushing 28. Positioned in the midportion of the lower outer surface of the cap 36 is a lug member 42 which is used in locking the wrench. The lug 42, which is circular on the inner and outer curves with rounded ends to distribute the shearing forces on the lug 42, flares outwardly from its point of attachment to the cap 36 adjacent the rounded ends of the lug 42. This configuration, which results in a larger size for the lug 42 at the outer end thereof, aids in keeping the locking mechanism engaged when in use.

A hemispherical shaped stop member 44 is secured to the upper surface of the drive shaft 32 adjacent the outer end thereof. The stop member 44 fits within a channel 56 in a second or outer cap 48 which is positioned on the outer end of the drive shaft 32. The outer cap 48 includes a planar portion 50 with a central box-shaped portion 52 of square cross section extending outwardly therefrom. The outer cap 48 has a generally cube shaped inner bore 54 with channel portion 56 extending upwardly therefrom and parallel to the longitudinal axis of the shaft 32. The inner bore 54 is of a size just large enough to receive the outer end of shaft 32 as shown in FIG. 1. The channel 56 terminates at its inner end adjacent planar portion 50 and, from that point, that part of planar portion 50 which is adjacent the upper surface of the drive shaft 32 is provided with a rounded or chamfered configuration, for ease in assembling the outer cap 48 over the stop member 44.

A spring mechanism 58 is positioned in biasing relation between the outer end of the drive shaft 32 and the outer end wall of the box-shaped portion 52 of the outer cap 48. The force of the spring 58 should be sufficient to force the caps 36, 48 apart when pressure has been released on the outer surface of the cap 48 during use.

The locking mechanism is easily engaged by aligning the lug 42 on the inner cap 36 with either of the openings 60 in the outer cap 48. The openings 60 match the lug 42 in shape, being large enough to receive the outwardly tapered portion of the lug 42 which is larger than the inner portion thereof adjacent inner cap 36. By slightly pressing on the casing handle 21 with intent to push the wrench upper housing 30 directly at the nut or bolt being turned, the faces of the caps 36, 48 will move to a position flush against each other with the result that the outer cap 48 will prevent the drive shaft 32 from rotating. In this locked configuration, the wrench 10 may be used in a conventional manner by applying pressure on the casing handle 21 so as to rotate the handle 21 about the axis of the drive shaft 32.

Once locked, the wrench 10 will remain in the locked position as long as contact is maintained with the nut or bolt under pressure. This is due to the slight outwardly tapered bevel of the lug 42 and also due to the fact that the static force between the lug 42 and the opening 60 in the outer cap 48 is greatly increased by the application of force on the casing handle 21. The static friction force on the knob during use is far greater than the force of the spring 58, so that the spring 58 is only effective to unlock the caps 36, 48 when pressure of the wrench 10 against the nut or bolt has been released. As the outer cap 48 moves outwardly during the unlocking sequence, the stop member 44 will prevent the cap 48 from coming off the drive shaft 32, as the stop member 44 will impinge against the inner wall of the channel 56 as shown in FIG. 1. In this unlocked position, the T-handle 34 may be used to control the rotation of the drive 32 for use of the wrench 10 in situations in which conventional wrench operation is difficult or impossible.

The lug 42 should be positioned sufficiently below the drive 32 so as not to interfere with operation of the socket. Also, the outer cap 48 should be constructed of sufficiently resilient material to allow for engaging the disengaging of the cap 48 with the lug 42 and to allow for ease of assembly of the cap 48 relative to stop member 44.

The wrench construction of the present invention is particularly advantageous in that all the pressure is off the gears when the wrench is being used in the conventional manner.

In one embodiment, the wrench 10 of the present invention had a gear shaft 12 with diameter of $\frac{3}{8}$ inch and a pinion shaft 14 with diameter of 3/16 inch. The square drive 32 was of $\frac{1}{4}$ inch size. In this embodiment, the bevel gear 16 had a diameter of about 1.04 inch and the bevel pinion 18 had a diameter of about 0.59 inch. The inner 36 and outer 48 caps had their planar faces of approximately 1/16 inch in thickness and the lug 42 was about 3/32 inch in length. The stop member 44 was approximately 1/16 inch in diameter and the length of channel portion 56 was approximately 5/32 inch.

In the embodiment as shown in FIGS. 4 through 8, there is provided a locking mechanism which includes a reversing ratchet wheel 70 having an outwardly extending box shaped portion 72 of square cross section. The ratchet wheel 70 and portion 72 have a bore 74 therein of square cross section, of a size just large enough to receive the square drive shaft 32. A set screw 76 is employed to secure the ratchet wheel 70 and portion 72 to the drive shaft 32.

An L-shaped ratchet pawl 78 with lower end 79 is positioned for engagement with the ratchet wheel 70, being mounted in pawl casing 80 which is secured to the face of the housing 30. The pawl 78 is free to move in the direction of its axis but is biased into engagement with the ratchet wheel 70 by a spring 82. When the pawl 78 is turned one-half revolution, as shown in Figs. 6 and 7, the driving face 84 of the pawl 78 engages opposite sides of the teeth 86 of the ratchet wheel 70. In FIG. 8, the pawl 78 has been turned a quarter revolution and depressed into notch 88 to allow the ratchet wheel 70 to turn freely without being engaged by the pawl 70. Suitable openings in the lower end of pawl casing 80 allow the pawl 78 to be positioned as described herein.

In one embodiment, the diameter of the ratchet wheel 70 was 1 inch and portion 72 provided a 3/8 inch drive. Each of the ratchet teeth 86 was approximately 0.13 inch across and with a thickness of about $\frac{1}{8}$ inch. The gaps between teeth were about 0.131 inch and each tooth was about $\frac{1}{8}$ inch in height. In this embodiment, the diameter of the pawl 78 at the upper end was about $\frac{1}{8}$ inch.

The ratchet construction of the present invention provides the wrench with the ability to work cross threaded bolts or bolts under a bind and also allows the wrench to be worked with more ease in the locked position. The work requiring a mechanical advantage in torque is a very small percentage when compared to the mechanical advantage required in speed (percent) when removing nuts, bolts and the like. The ratchet addition enables this small percentage to be worked most effectively. Thus without removing the wrench from the nut, for example, the wrench can be "locked" in the desired direction.

The wrench of the present invention provides a more efficient use of effort than previously known wrenches. In most cases, the mechanical advantage in torque with the present invention is only needed for about one-quarter turn of the bolt while the mechanical advantage in speed is needed for the remaining turns of the bolt. The exceptions to this would be when the bolt is under a great bind, which it should not be, or when the bolt is cross-threaded, which also should not be the case.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A socket wrench with reversing ratchet comprising: an elongated casing; a gear shaft mounted coaxially within said casing; a bevel gear mounted on one end of said gear shaft; a T-shaped handle member mounted on the other end of said gear shaft, said gear shaft being formed as an integral unit with the bevel gear so that rotation of said handle member results in direct rotation of said bevel gear, said gear shaft being in the form of a single straight continuous shaft from the bevel gear on said one end of the gear shaft to the T-shaped handle on said other end of the gear shaft; a pinion shaft mounted in said casing adjacent said bevel gear and extending perpendicular to said gear shaft; a bevel pinion mounted on one end of said pinion shaft in engagement with said bevel gear; a drive shaft mounted on said bevel pinion so as to be coaxial with said pinion shaft and extending outwardly from said casing; a pair of bushings mounted in said casing, with one end of said pinion shaft and one end of said drive shaft each being mounted in a respective one of said bushings; a planar cap member mounted on said casing, said cap member acting to secure the bushing in which said drive shaft is mounted; a drive stud mounted on said drive shaft for engagement with a workpiece; a ratchet wheel having a plurality of teeth around the circumference thereof, said ratchet wheel being mounted on said drive shaft and rotatable therewith; and means for releasably engaging said ratchet wheel to prevent rotation of said drive shaft, said engaging means including a pawl member mounted on said casing, said pawl member being free to move in a direction along its longitudinal axis and with means for biasing said pawl into engagement with said ratchet wheel, the plane of said longitudinal axis being coincident with the plane of said ratchet wheel, said pawl being mounted in a pawl casing having a pair of notches formed therein and so positioned relative to each other that said pawl may be received in either of said pair of notches upon being rotated about its longitudinal axis through an angle of 180 degrees, said pawl casing having a center notch corresponding to an angle of rotation of said pawl about its longitudinal axis by an angle of 90 degrees from either of said pair of notches, said pair of notches being positioned closer to said ratchet wheel than said center notch so that said biasing means allows said pawl to engage the ratchet wheel when positioned in either of said pair of notches while allowing said ratchet wheel to rotate free of engagement with the pawl when said pawl is in the center notch.

2. The socket wrench of claim 1 wherein said drive stud includes a box shaped portion which extends outwardly from the central portion of said ratchet wheel, said box shaped portion having a bore therein of a size to receive the drive shaft.

3. The socket wrench of claim 2 wherein the ratchet wheel has a bore therein of square cross section which receives the drive shaft.

4. The socket wrench of claim 1 wherein said drive shaft is of generally square cross section outwardly of said casing.

* * * * *